US005907937A

United States Patent [19]

Loftus et al.

[11] Patent Number: 5,907,937

[45] Date of Patent: Jun. 1, 1999

[54] BLOCK WALL CONSTRUCTION SYSTEM AND COMPONENTS THEREOF

[75] Inventors: Roy Loftus; William Hugh Burke, both of Perth, Australia

[73] Assignees: W. Loftus & Co. Pty Ltd.; Glass Block Constructions, both of Australia

[21] Appl. No.: 08/669,356

[22] PCT Filed: Dec. 22, 1994

[86] PCT No.: PCT/AU94/00788

§ 371 Date: Jun. 28, 1996

§ 102(e) Date: Jun. 28, 1996

[87] PCT Pub. No.: WO95/18278

PCT Pub. Date: Jul. 6, 1995

[30] Foreign Application Priority Data

Dec. 31, 1993 [AU] Australia ..... PM3206

[51] Int. Cl.[6] ..... E04C 1/42

[52] U.S. Cl. ..... 52/308; 52/477; 52/601; 52/656.1; 52/656.9; 52/762; 52/764; 52/779; 52/781.3; 52/786.1

[58] Field of Search ..... 52/308, 442, 386, 52/477, 762, 764, 779, 780, 781.3, 677, 656.1, 656.9, 601, 786.1

[56] References Cited

U.S. PATENT DOCUMENTS

| | | | |
|---|---|---|---|
| 2,239,637 | 4/1941 | Zesewitz . | |
| 2,314,238 | 3/1943 | Ohlis . | |
| 4,019,302 | 4/1977 | Meyer . | |
| 4,570,406 | 2/1986 | DiFazio . | |
| 4,793,104 | 12/1988 | Hultberg . | |
| 4,965,975 | 10/1990 | Schwarz . | |
| 5,031,372 | 7/1991 | McCluer | 52/308 X |
| 5,224,314 | 7/1993 | Chen | 52/308 |
| 5,259,161 | 11/1993 | Carter . | |
| 5,485,702 | 1/1996 | Sholton | 52/308 |

FOREIGN PATENT DOCUMENTS

| | | |
|---|---|---|
| 21324/67 | 5/1967 | Australia . |
| 592/76 | 12/1976 | Australia . |
| 31279/84 | 2/1985 | Australia . |
| 70033/87 | 3/1986 | Australia . |
| 87/05961 | 10/1987 | Australia . |
| 692/91 | 1/1991 | Australia . |
| 0-122210 | 3/1984 | France . |
| 0122210 | 3/1984 | France . |
| 89-04049 | 3/1989 | France . |
| 8707630 U | 5/1987 | Germany . |
| 89/06727 | 7/1989 | Germany . |
| 62-244935 | 10/1987 | Japan . |

*Primary Examiner*—Christopher Kent
*Attorney, Agent, or Firm*—Dougherty & Associates

[57] ABSTRACT

An interstitial junction spacer for positioning and supporting a plurality of blocks in a matrix for a wall construction, the blocks being of the type having two parallel rectangular side faces and four adjoining end faces orthogonally adjoining the corresponding edges of the side faces and the ends of each other contiguously to form a continuous circumferential edge of the block, the profile of the circumferential edge being substantially concave, whereby the corresponding edges of the side faces define an outer cusp along the opposing sides of each said end face; said spacer comprising a pair of intersecting and integral spacer means, each spacer means having a pair of coplanar edge members of a prescribed thickness adapted to repose in juxtaposition with the outer cusps of the circumferential edge of a said block along the adjoining end of the end face of the block to space the same from another block or surface disposed adjacent to said block, and an interconnecting web portion to integrally interconnect said spacer means together.

57 Claims, 10 Drawing Sheets

BLOCK WALL CONSTRUCTION SYSTEM AND COMPONENTS THEREOF

TECHNICAL FIELD

This invention relates to a block wall construction system and components thereof including a reinforcing interstitial spacer system and an interstitial junction spacer for use therewith.

The invention has particular utility in the construction of glass block walls, but is not limited to walls constructed of such blocks, whereby the invention may also have utility in walls constructed from other types of blocks.

BACKGROUND ART

With particular respect to glass block wall construction, a number of different types of construction systems are employed, each of which have their own associated advantages and disadvantages due to the special and somewhat unique characteristics of glass blocks.

One of the features of glass block construction which is making it become increasingly popular, is its high aesthetic appeal. This is enhanced by the use of modular blocks of substantially identical size and shape which are bonded in a rectangular matrix as opposed to an offset bond, the latter being preferred for brickwork in order to maintain the strength thereof. Subsequently, the bonding of glass blocks in a rectangular matrix generally requires interstitial reinforcement between the blocks to maintain the strength thereof.

Two principal types of binders are used with glass blocks namely mortar and silicone caulking. In mortar, a relatively strong bond can be achieved, however the appearance of mortar joints in glass block walls differs markedly from the appearance of silicone joints, and so these types of binder have different appeal to different people.

Silicone can provide an aesthetically appealing joint between glass blocks, it being of a similar colour to glass or alternatively being able to be pigmented to any desirable colour, and is able to be used with smaller spaced joints so that the joints do not detract from the appearance of the glass blocks.

With both types of binder, expansion and contraction of the glass blocks with variations in temperature needs to be accommodated. This is a major problem where the glass block wall needs to connect to either a frame or a wall made of some other material which has a different rate of expansion or contraction. As glass is extremely fragile this expansion or contraction can result in cracking of the glass blocks themselves or the joints if this expansion and contraction is not accommodated. Consequently, the use of a modular framing system has become popular with the construction of glass block walls, wherein a glass block wall matrix is constructed within a rectangular frame of a predetermined size which allows for a void to be disposed between the interface of the periphery of the glass block wall and the inner surface of the frame itself along the jambs, the head and the sill of the frame. The void along the jambs may be occupied by a suitable flexible medium such as polystyrene foam to allow for the expansion and contraction of the glass blocks within the frame.

A series of these glass block wall frames can be constructed and interconnected to form a matrix of glass block wall frames which in turn form a composite wall of the appropriate size.

Notwithstanding the adoption of these types of framing systems for the laying of glass blocks, there is still a need to reinforce the joints due to the orthogonal bond required for the blocks. This is particularly so with the use of silicone as a binder which simply does not have the same inherent strength characteristics as mortar. Even with the increased strength characteristics of mortar, it is still necessary to use some kind of reinforcement when using this as a binder, particularly with external walls.

In the case of wall construction using mortar as a binder, 6 mm diameter galvanised steel rod has been used which is embedded within the mortar layer to reinforce the bonding. In the case of wall construction using silicone as a binder, it has been found necessary to use a stronger reinforcement such as galvanised flat bar of 50 mm×3 mm, which is positioned within the interstices of the joints by elaborate fixing methods.

Another problem with the laying of glass blocks is the need to achieve and maintain an orthogonal bond in order to ensure clean aesthetic appearance. Although the achievement of straight horizontal joints is relatively simple with most block laying techniques, be it brick laying or glass block laying, the achievement of straight and neat vertical joints is much more difficult. Consequently, the use of spacers to precisely space the blocks apart both horizontally and vertically has become standard practice throughout the industry to achieve clean, straight and consistent spacing between the blocks along the joints.

In order to accommodate both reinforcement and spacing requirements for glass block wall construction, the design of spacers has become quite involved.

With respect to glass block wall construction using mortar as a binder, the spacers are required to be quite thick and bulky to achieve glass block spacings of the standard 10 mm adopted for mortar joints, whereas with the use of silicone as a binder, the spacers are much thinner, requiring them to be more complex in design. The complexity of the design of spacers is due in part to accommodating reinforcement members and in part to the complex shape of the adjoining end faces of the glass blocks.

In this respect, a typical glass block comprises two parallel rectangular side faces which become the exposed faces of the block and four adjoining end faces which orthogonally adjoin the corresponding edges of the side faces. The ends of each of these side faces contiguously adjoin each other orthogonally to form a continuous circumferential edge of the block which is convexly curved at each of its corners. However, the profile of the circumferential edge is substantially concave whereby the corresponding edges of the side faces each define an outer cusp along the opposing sides of each end face as well as a central inner cusp which is disposed intermediate the opposing side faces of each end face. This inner cusp extends continuously along the circumferential edge of the block on each of the side faces of the block forming the same.

Due to the lesser reinforcement required with mortar joints, the design of spacers for glass block wall construction using this type of binder is relatively simple and consequently a variety of spacers are available on the market for this purpose. One of the better types of spacers for this purpose is the subject of Australian Patent No 608220.

In the case of glass block wall construction which uses silicone as a binder, due to the decreased spacing requirements of the blocks, typically being in the order of 3 mm and the increased reinforcement required, the design of spacers has been much more complex. Two systems which are most commonly used in the trade in Australia are the subject of Australian Patent No 637665 and Australian Patent Specification No 29361/89 respectively. Both of these systems, whilst becoming popular, still have considerable disadvantages associated therewith.

In the case of Australian Patent No 637665, the spacer and reinforcement member are one and the same, in this case, being a member formed of a flexible plastics material such as flexible polyvinyl chloride. This member is dispensed in prescribed lengths which span the entire horizontal joint, being cut from a large roll of the same. Unfortunately, due to the flexible nature of the spacer material, the reinforcement is not as strong as can be achieved by the use of metal reinforcement bars and so the utility of this type of glass block wall construction is limited principally to internal walls, where the lateral loading requirements are not as critical as with external walls. Furthermore, discrete lengths of the member are cut and disposed between the blocks to form the vertical spacing. The discrete nature of the vertical spacers however provides no additional strength characteristics and so these members function solely as a spacer and not as reinforcement.

In the case of Australian Patent Specification No 29361/89, which describes what is commonly known as the "Steckfix" (trade mark) system , this system overcomes the loading limitation of the previous system to a significant degree by utilising a flat metal bar as the reinforcing member and discrete plastic spacers which are connected to the bar for the spacing requirements. The inherent strength of the flat metal bar significantly improves the loading characteristics of glass block walls constructed in accordance with this system and hence such walls can be used both internally and externally. A problem with this system, however is that the spacers which connect to the flat metal bar allow for spacing in only one direction.

In the case of the flat metal bars being disposed horizontally, the spacer which is connected to the bar is only capable of spacing the horizontal joints and hence a discrete spacer is required to provide the spacing for the vertical joints. Conversely, if the bars are disposed vertically, discrete spacers are required to provide for the spacing of the horizontal joints. Again, as these discrete spacers are separate from the spacers which are connected to the reinforcing metal bar, they do not contribute at all to the loading characteristics of the wall.

Another disadvantage of this system is that only one side of the spacer conforms to the complex shape of the end face profile of the glass block, the other side of the spacer by virtue of accommodating the flat bar, does not conform to the complex shape of thee end face profile. Hence the maximum strength that could otherwise be obtained from the bar if it was to more positively engage the confronting faces of both adjacent blocks, is not achieved.

DISCLOSURE OF INVENTION

It is an object of the present invention to enable for the construction of block walls with improved loading requirements whilst simultaneously providing for the precise spacing of the blocks along both the vertical and horizontal joints.

In accordance with one aspect of the present invention, there is provided an interstitial junction spacer for positioning and supporting a plurality of blocks in a matrix for a wall construction, said blocks being of the type having two parallel rectangular side faces and four adjoining end faces orthogonally adjoining the corresponding edges of the side faces and the ends of each other contiguously to form a continuous circumferential edge of the block, the profile of the circumferential edge being substantially concave, whereby the corresponding edges of the side faces define an outer cusp along the opposing sides of each said end face; said spacer comprising:

a pair of intersecting and integral spacer means, each spacer means having a pair of coplanar edge members of a prescribed thickness adapted to repose in juxtaposition with the outer cusps of the circumferential edge of a said block along the adjoining end of the end face of said block, to space the same from another block or surface disposed adjacent to said block; and an interconnecting web portion to integrally interconnect said spacer means together;

wherein said spacer means are particularly adapted to accommodate and retainedly dispose an elongate reinforcement member therein in coplanar relationship with one of said spacer means and in orthogonal relationship with the other of said spacer means.

Preferably, the outer surface of each edge member of one or the other said spacer means is tapered inwardly, from the proximal end of the edge member to the distal end of the edge member. In this manner, the spacers can be used in the construction of a curved wall, whereby the inward tapering of the outer surface prevents the spacer from projecting outwardly from the wall which would otherwise arise in the absence of such tapering.

Preferably, in one form of junction spacer, said web portion is biased towards one side of said spacer means thereof, having: (i) an outer surface of substantially complementary shape to the confronting surface of the end face of an adjacent block, whereby the profile of said outer surface is substantially convex to repose between the outer cusps of the rectilinearly aligned outer cusps, and (ii) an inner recessed surface to engage and connect the spacer to the elongate reinforcement member for accommodating the same within the interstices of a matrix formed by said blocks.

Preferably, in another form of junction spacer, the other spacer means is formed with a pair of opposing transverse grooves at the junction with the one spacer means, the longitudinal extent of each said groove being respectively disposed in parallel alignment with each edge member of said one spacer means, said grooves being sized and shaped for retainedly accommodating the opposing edges of the elongate reinforcement member.

Preferably, in said other form of spacer, the spacer is for spacing an end interstitial junction, wherein the one spacer means projects from said other spacer means on only one side of the spacer, the opposing side of the spacer being planar to engage a planar surface confronting the end of the block.

Preferably, in said other form of spacer, the web portion is provided with one or more holes to facilitate fixing the spacer to the confronting planar surface.

Preferably, in said other form of spacer, said web portion is provided with a central aperture, through which said elongate reinforcement member may extend.

Preferably, in said one form of junction spacer, the spacer is for an intermediate interstitial junction, whereby said interconnecting web portion is formed with a central longitudinal groove along its outer surface for accommodating a central inner cusp formed intermediate the opposing sides of each end face of a pair of adjacent blocks which are rectilinearly aligned, the inner cusp of each block extending continuously along the circumferential edge of each block.

Preferably, in said one form of intermediate spacer, the spacer is provided with a plurality of outwardly projecting spacer tabs disposed along the outer surface of the interconnecting web portion at the junction of the web portion with said one spacer means, said spacer tabs being angularly disposed to project marginally inwardly from each of said edge members for engaging the concave surface of an end face of an adjacent block to facilitate positioning the spacer within the confines of the end face of the block.

Preferably, in said one form of intermediate spacer, the spacer includes a plurality of opposing spacer tabs projecting outwardly from each of said edge members of said one spacer means proximate to the junction between the edge members and the interconnecting web portion adjacent to the inner recess surface of said web portion, said opposing spacer tabs being angularly disposed to project marginally inwardly from each of said edge members of engaging the concave surface of an end face of the adjacent block and for partly retaining the reinforcement member therein.

Preferably, in said one form of intermediate spacer, the spacer includes a pair of retentioning tabs, one disposed along each inner edge of the edge members of said other spacer means proximate to the junction with the inner edge of the corresponding edge members of said one spacer means, said retentioning tabs projecting marginally inwardly over said inner recessed surface of said web portion to define an overhanging surface substantially parallel with said inner recessed surface for retaining the reinforcement member in position.

In accordance with another aspect of the present invention, there is provided a reinforcing interstitial spacer system for positioning and supporting a plurality of blocks in a matrix for a wall construction, the blocks being of the type defined in the preceding aspect of the invention; said system comprising:

a) an elongate reinforcement member having a pair of opposing expansive sides, substantially complementary in shape to that portion of an end face of a block between the outer cusps thereof, whereby thee profile of each expansive side is substantially convex to repose between the outer cusps; and b) a plurality of interstitial junction spacers of the type defined in the preceding aspect of the invention, mutatis mutandis, for spacing the end and intermediate interstitial junctions between the blocks.

In accordance with a further aspect of the present invention, there is provided a block wall construction system comprising:

i) a plurality of blocks of the type defined in the preceding aspects of the invention;

ii) a reinforcing interstitial spacer system as defined in the preceding aspect of the invention; and iii) a binder for filling the outer spaces of the interstices of a matrix formed by said blocks and said reinforcing interstitial spacer system to bind the same together and form a stable wall construction.

Preferably, said binder is a silicone caulking material.

BRIEF DESCRIPTION OF DRAWINGS

The invention will be better understood in the light of the following description of one principal and specific embodiment thereof. The description is made with reference to the accompanying drawings, wherein.

BEST MODE FOR CARRYING OUT THE INVENTION

The embodiment is directed towards a glass block wall construction system which involves the erection of a plurality of glass blocks to construct a wall using a reinforcing interstitial spacer system and a binder. The interstitial spacer system comprises the use of a series of elongated reinforcement members and a plurality of interstitial junction spacers. The binder is in the form of silicone caulking material or similar which is suitable for binding glass blocks together.

Figure 1:
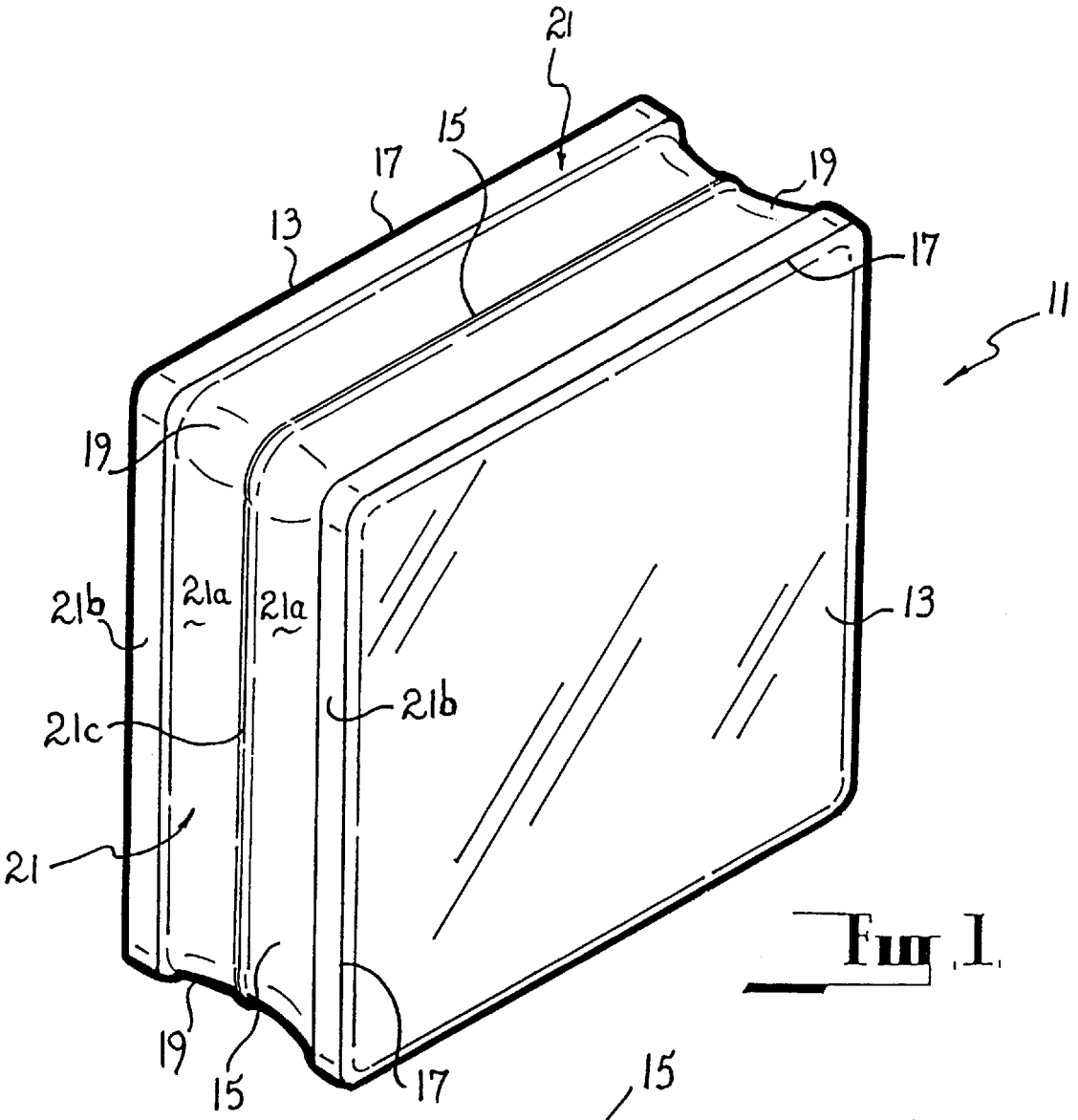
FIG. 1 is a perspective view of a glass block of the standard type.
Figure 2:
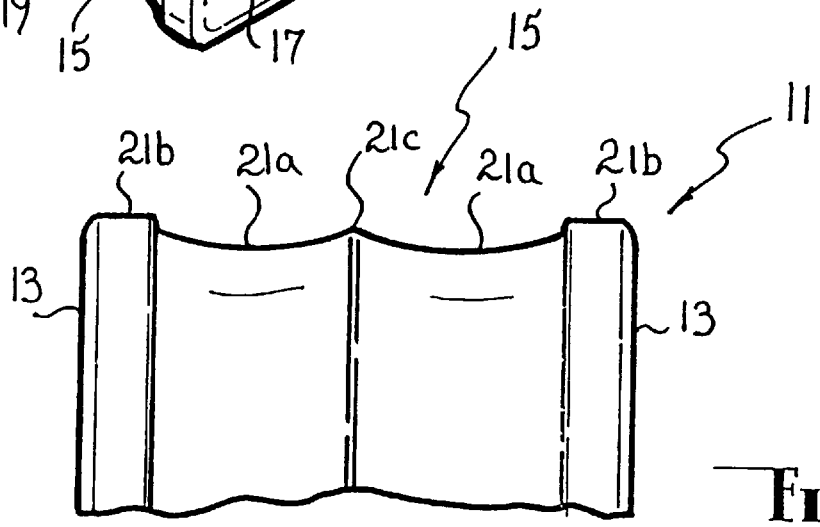
FIG. 2 is a cross sectional view of the end face profile of the block shown in FIG. 1 of the drawings.

As shown in FIGS. 1 and 2, a typical glass block 11 which is used in the present enbodiment comprises two parallel rectangular side faces 13 and four adjoining end faces 15. The end faces 15 adjoin the corresponding edges 17 of both of the side faces 13 of the block, and furthermore adjoin the ends 19 of each other, contiguously, to form a continuous circumferential edge 21 around the block.

The profile of the circumferential edge 21 is more clearly shown in FIG. 2 of the drawings and generally comprises an inner substantially concave portion 21*a*, a pair of outer cusps 21*b* and a central inner cusp 21*c*. The outer extremities of the outer cusps 21*b* are defined by the corresponding edges 17 of each of the side faces 13 and form a planar land along the opposing sides of each end face 15, substantially orthogonal to the outer surface of the side faces 13. The central inner cusp 21*c* is formed intermediate the outer cusps 21*b* and extends continuously along the circumferential edge 21 of the block, dividing the concave portion 21*a* of each end face 15 into two.

This complex profile results from the method of construction of a glass block, whereby the block is actually formed from two rectangular shells which are disposed so that the open ends thereof confront each other and are welded together, the inner cusp constituting the weld seam between the adjoining edges of the two shells.

This profile over the range of glass blocks of different manufacture is generally the same, variations generally only occurring with respect to the degree of concavity of the concave portions 21*a* and the width of the inner cusp 21*c*. Apart from these variations, however, the profile of glass blocks is generally uniform throughout the industry, whereby the outer cusps 21*b* are generally always marginally higher than the inner cusp 21*c*, and are formed with a flat land.

Figure 7:
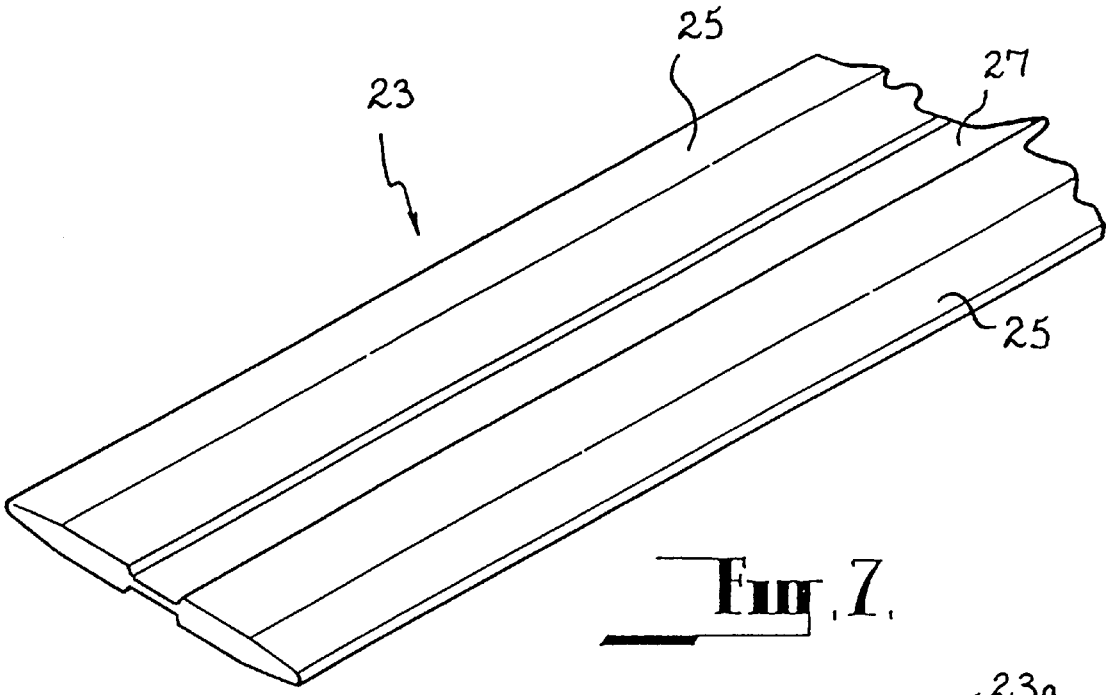
FIG. 7 is a fragmentary perspective view of the reinforcement member.
Figure 8:
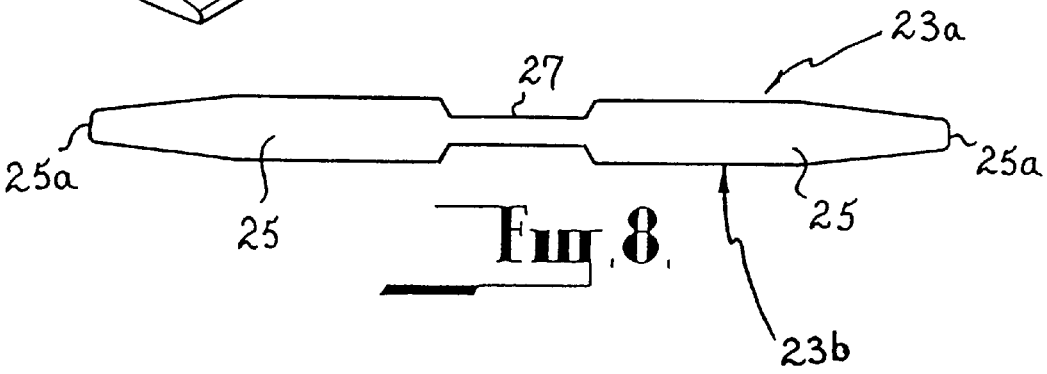
FIG. 8 is an end view of FIG. 7.
Figure 13:
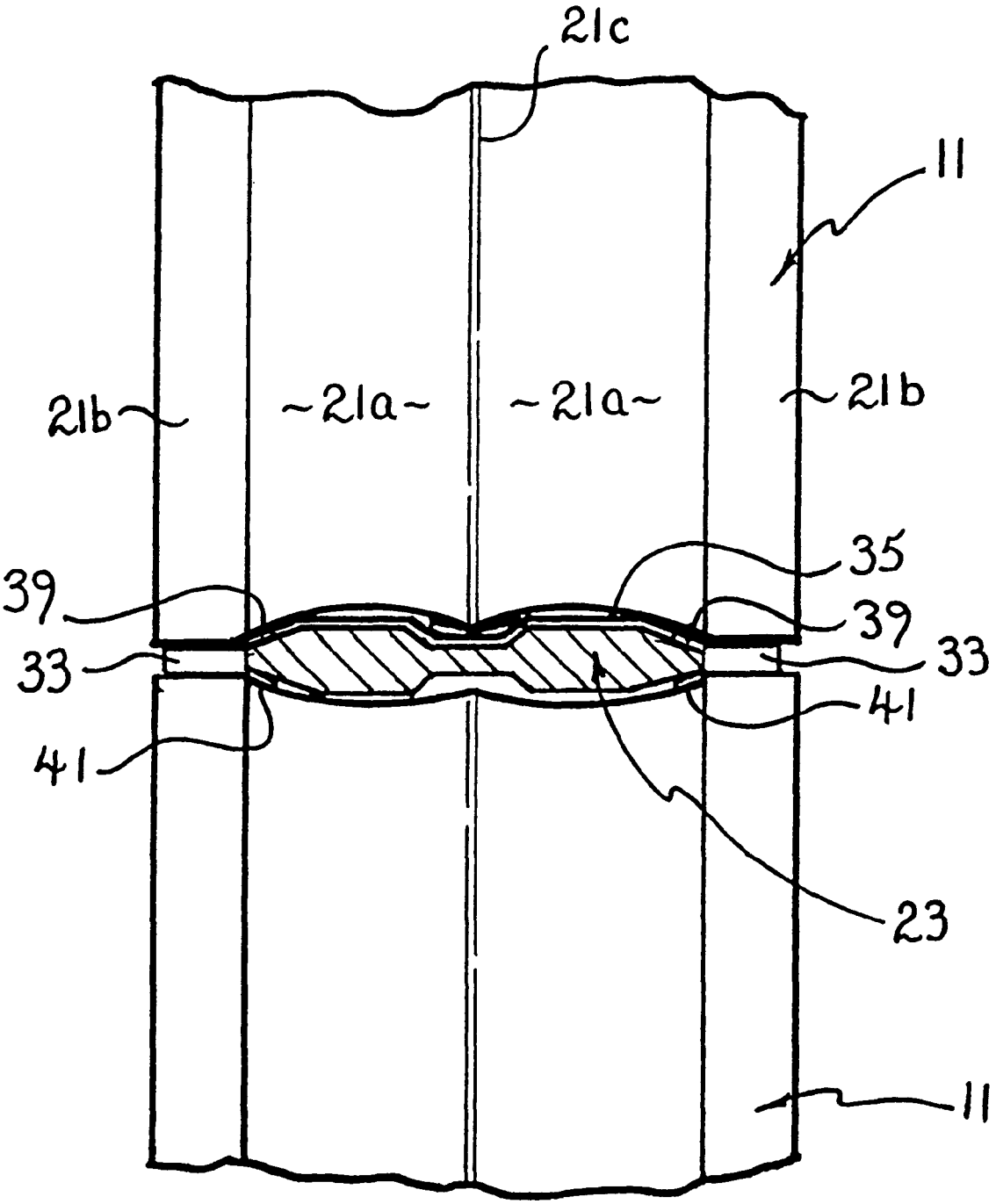
FIG. 13 is a fragmentary sectional view showing the positioning of the reinforcing interstitial spacer system between a pair of adjacent glass blocks.

The elongated reinforcement member 23 which is used in the present embodiment is shown in FIGS. 7 and 8 of the drawings and essentially comprises a metal bar of aluminium or similar material. The bar is specially formed to adopt a cross-sectional shape which is substantially similar to the cross-sectional shape of the cavity or void formed between a pair of adjacent glass blocks, marginally spaced apart as best shown in FIG. 13 of the drawings.

Moreover, the reinforcement member 23 is of a flattened shape comprising a pair of thickened wings 25 which are interconnected by a central web 27. The web 27 is of thinner dimension than the wings 25, forming an elongated groove to be disposed within the space provided between a pair of confronting inner cusps 21*c* of a pair of adjacent blocks, accommodating the cusps. The wings 25 are generally convexly shaped to complement the shape of the concave portion 21*a* of a glass block on which the member reposes. The transverse extent of the member is commensurate to the distance between the outer cusps 21*b* so that the outer edges 25*a* of the member repose proximate to the junction between the outer cusps 21*b* and the respective concave portions 21*a*. Thus, the elongated reinforcement member essentially has a pair of opposing expansive sides 23*a* and 23*b* which are substantially complementary in shape to that portion of the end face 15 of a block which extends between the outer cusps thereof.

Although the profile of each expansive side is substantially convex to repose between the outer cusps and the web portion 27 defines a central groove to accommodate the inner cusp, the size of the member is marginally smaller than the resultant size of the cavity or void between the blocks to allow for expansion and contraction of the glass blocks with changes in temperature. This marginal difference in size is achieved by the arrangement of the interstitial junction spacers therewith, which now will be described.

The interstitial junction spacers are formed of polypropylene plastic material and are in two forms, one form being an intermediate junction spacer which is disposed at each internal junction of the matrix of glass blocks forming the wall, and the other form being an end junction spacer which is disposed at the end junctions between the glass blocks running along the sill and the jambs of the frame or surround within which the wall is constructed.

Figure 3:
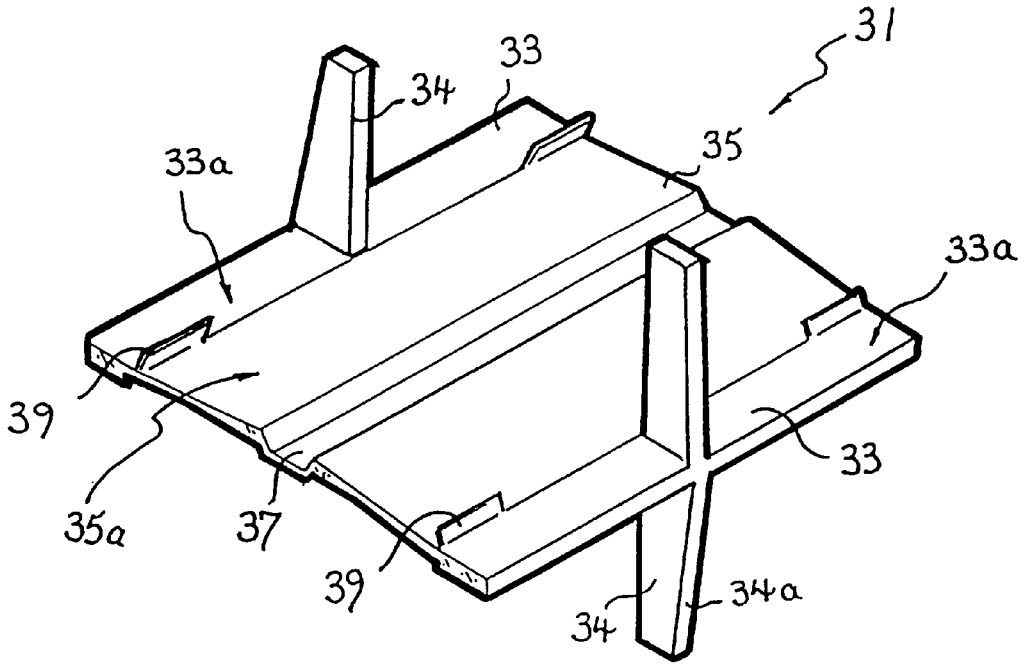
FIG. 3 is a top perspective view of an intermediate junction spacer.
Figure 4:
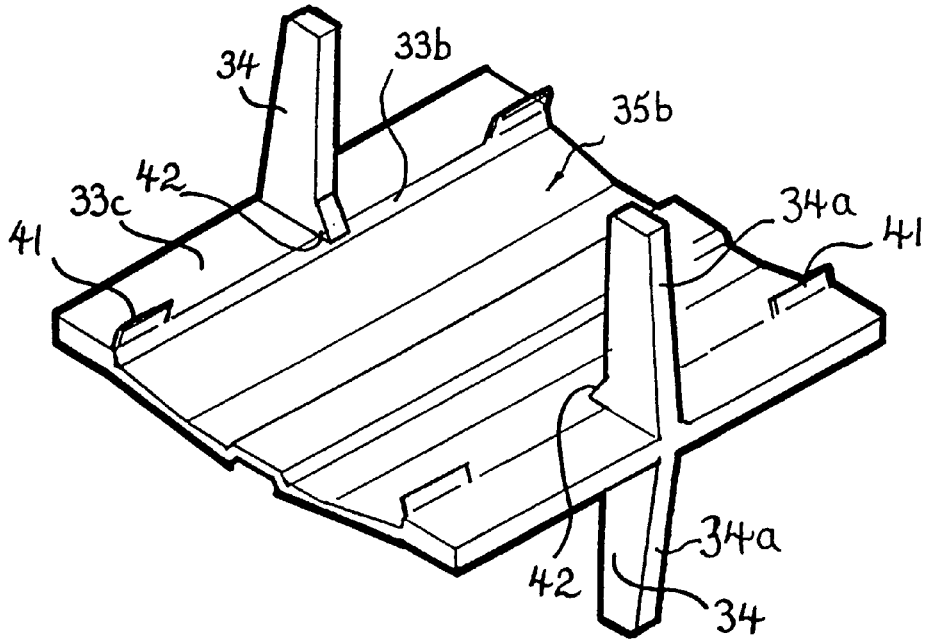
FIG. 4 is an underside view of FIG. 3.

The intermediate junction spacer 31 as shown in FIGS. 3 and 4, essentially comprises a pair of intersecting spacer means which are integral with each other. Each spacer means has a pair of coplanar edge members 33 or 34 so that one pair of edge members 33 are formed as part of one spacer means and the other pair of edge members 34 are formed as part of the other spacer means. The intersection of the spacer means results in the edge members forming a cross as shown in the drawings, at each side of the spacer. The thickness of each edge member 33 and 34 is the same, in the present embodiment being 3 mm. This thickness corresponds to the spacing required and achieved between the opposing edges 17 of adjacent blocks 11 in the manner that will be described in more detail later.

The one spacer means comprising the edge members 33 is formed with an interconnecting web portion 35 extending between the two edge members 33. The web portion 35 is biased towards one side of the spacer means, its outer surface 35*a* being contiguous with corresponding outer surfaces 33*a* of the edge members 33, which are in themselves coplanar with respect to each other.

The outer surface 35*a* of the web portion 35 is substantially complementary in shape to the confronting surface of the end face 15 of an adjacent glass block 11. Thus, the outer surface 35*a* is generally convex complementing the shape of the concave portions 23*a* of the end face of the block and being formed with a central elongate groove 37 to accommodate the inner cusp 23*c* of the same block.

A plurality of outwardly projecting spacer tabs 39 are disposed at the junction between the outer surface 35*a* of the web portion 35 and the corresponding outer surface 33*a* of the edge members 33 of the one spacer means. These spacer tabs 39 are disposed one at each side of the edge members 34 of the other spacer means and project marginally inwardly to define an acute angle with the outer surface 35*a* of the web portion. Importantly, the spacer tabs are sufficiently flexible and resilient by virtue of the inherent nature of the polypropylene material of which they are formed to take up any variance between the complementary shape of the outer surface of the web portion 35 and the concave portion 23*a* of an adjacent block.

The inner surface 35*b* of the web portion 35 is recessed and is essentially of complementary shape to an expansive side 23*a* or 23*b* of the reinforcement member 23 so that the spacer 31 can engage and connect to the reinforcement member. Thus the recess is terminated along its sides by opposing inner edges 33*b* of the edge members 33 substantially orthogonal to the corresponding outer surfaces 33*a*, so that the outer edges 25*a* of the reinforcement member 23 may situate proximate thereto.

A plurality of outwardly projecting opposing spacer tabs 41 are angularly disposed along the inner edge 33*b* of each of the edge members 33 at their respective junction with the opposite outer surface 33*c* to the corresponding outer surface 33*a*. These opposing spacer tabs 41 project marginally angularly inwardly over the inner recessed surface 35*b* of the web portion 35, so as to define an obtuse angle with the adjacent opposite outer surface 33*c* of the respective edge members. The opposing spacer tabs 41 are disposed one to each side of the other edge member 34 and function not only to take up any variance between the complementary shape of the exposed expansive side of the reinforcement member 23, when disposed within the confines of the inner recessed surface 35*b* of the web portion, and the confronting concave portion 23*a* of an adjacent block, but also to partly retain the reinforcement member in this confined position.

A pair of retentioning tabs 42 are provided one along each inner edge of the edge members 34 proximate to the junction with the inner edge 33*b* of the corresponding edge member 33. The retentioning tabs 42 have an outer tapered surface to allow the outer edges of the reinforcement member 23 to slide therealong when positioning the same, and an overhanging surface substantially parallel to the inner surface 35*a* of the web portion to retain the reinforcement in position once it engages the recess beneath the overhanging surface. Accordingly, the retentioning tabs 42 constitute the principal means by which the reinforcement member 23 is retained within the confines of the inner recessed surface 35*b* of the web portion 35.

Again, both the opposing spacer tabs 41 and the retentioning tabs 42 are sufficiently resilient to allow for the reinforcement member to be clicked into place within the inner recess where it is retained in position.

The edge members 34 of the other spacer means are tapered from each proximal end thereof adjoining the edge members 33 of the one spacer means, to the distal ends thereof. This tapering is provided to enable the spacer 31 to be used when constructing a curved wall, whereby the one spacer means will be disposed vertically and the other spacer means disposed horizontally. In this way, the tapering of the edge members 34 takes up the curvature of the horizontal joints, which curvature is achieved by adjacent blocks being marginally angularly offset to each other about a vertical axis. Accordingly, the outer surface 34*a* of the edge members 34 will not project beyond the joint which would otherwise occur if the outer surface was not so tapered.

Figure 5:
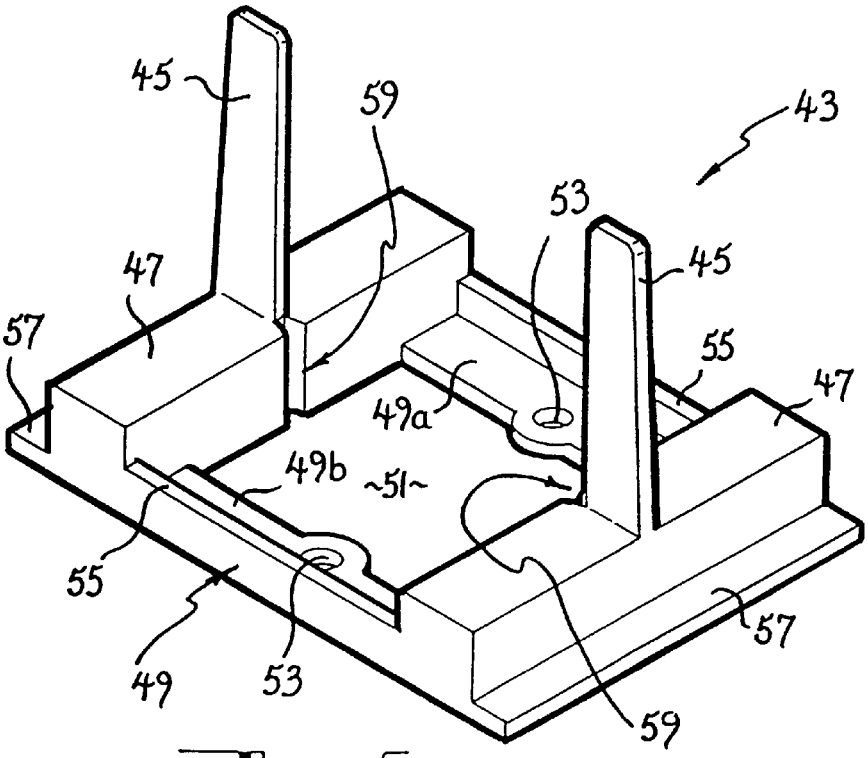
FIG. 5 is a top perspective view of an end junction spacer.
Figure 6:
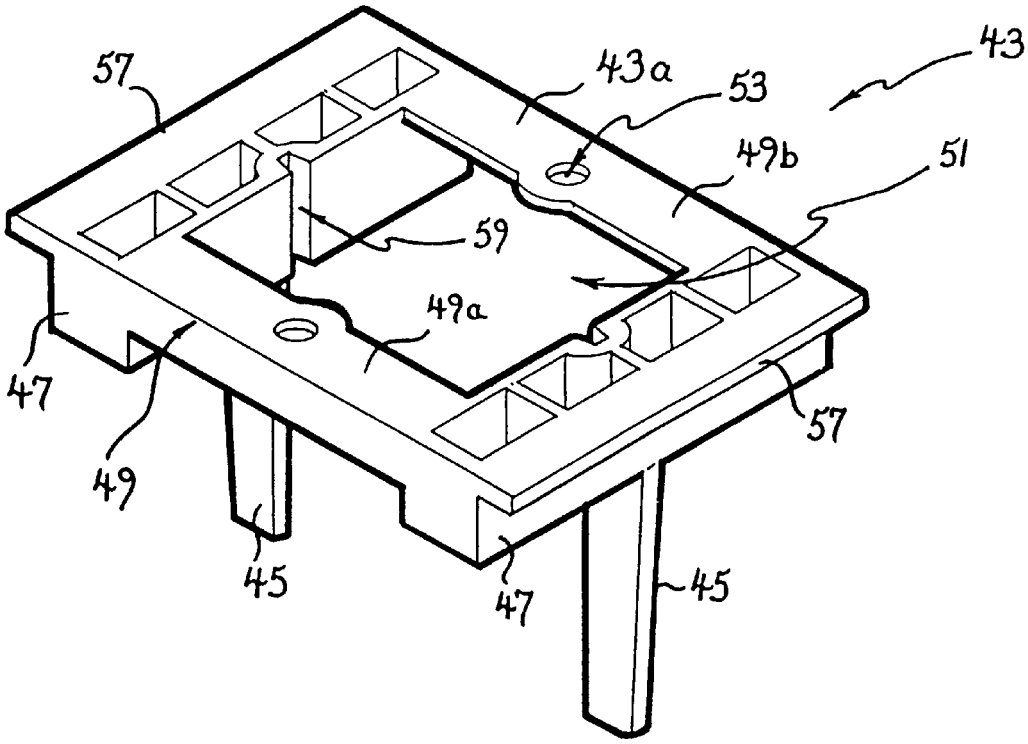
FIG. 6 is an underside view of FIG. 5.

The end junction spacer 43 is shown in FIGS. 5 and 6 of the drawings and in principle is similar to the intermediate junction spacer 31 but includes some significant differences.

As with the intermediate junction spacer, the end junction spacer 43 comprises a pair of intersecting spacer means which are integrally formed, each comprising a pair of coplanar edge members 45 and 47, the edge members 45 forming part of one of the spacer means and the edge members 47 forming part of the other spacer means.

As opposed to the intermediate junction spacer, the edge members 45 project from the other spacer means in only one direction, the opposing side 43*a* of the other spacer means being planar, as shown in FIG. 6 of the drawings, to facilitate engagement and affixment of the end junction spacer 43 to a planar surface which confronts the appropriate end of the block wall.

The other spacer means is also provided with an interconnecting web portion 49, however, as opposed to the intermediate junction spacer, the web portion 49 is formed with a central aperture 51 extending between the edge members 47, so that the web portion is effectively divided into two parts 49*a* and 49*b*, respectively interconnecting the edge members 47 at their opposing ends.

The web portion 49 is provided with a pair of holes 53 which are centrally disposed intermediate the edge members 47, one on each part 49*a* and 49*b* of the web portion. These holes 53 are provided to enable the junction spacer to be affixed to the confronting planar surface of the wall frame or the like.

Both parts 49*a* and 49*b* of the web portion are each provided with a longitudinal rail 55 which similarly extends between the edge members 47 for strengthening purposes. In addition, the web portion 49 includes an end flange 57 disposed at either end thereof to project laterally from the side of each edge member 47. Accordingly, the extent of the spacer 43 between the end flanges 57 is commensurate to the distance between the opposing sides of the frame member 29 within which the corresponding end row of glass blocks will repose, in a manner which will be described in more detail later.

Figure 9:
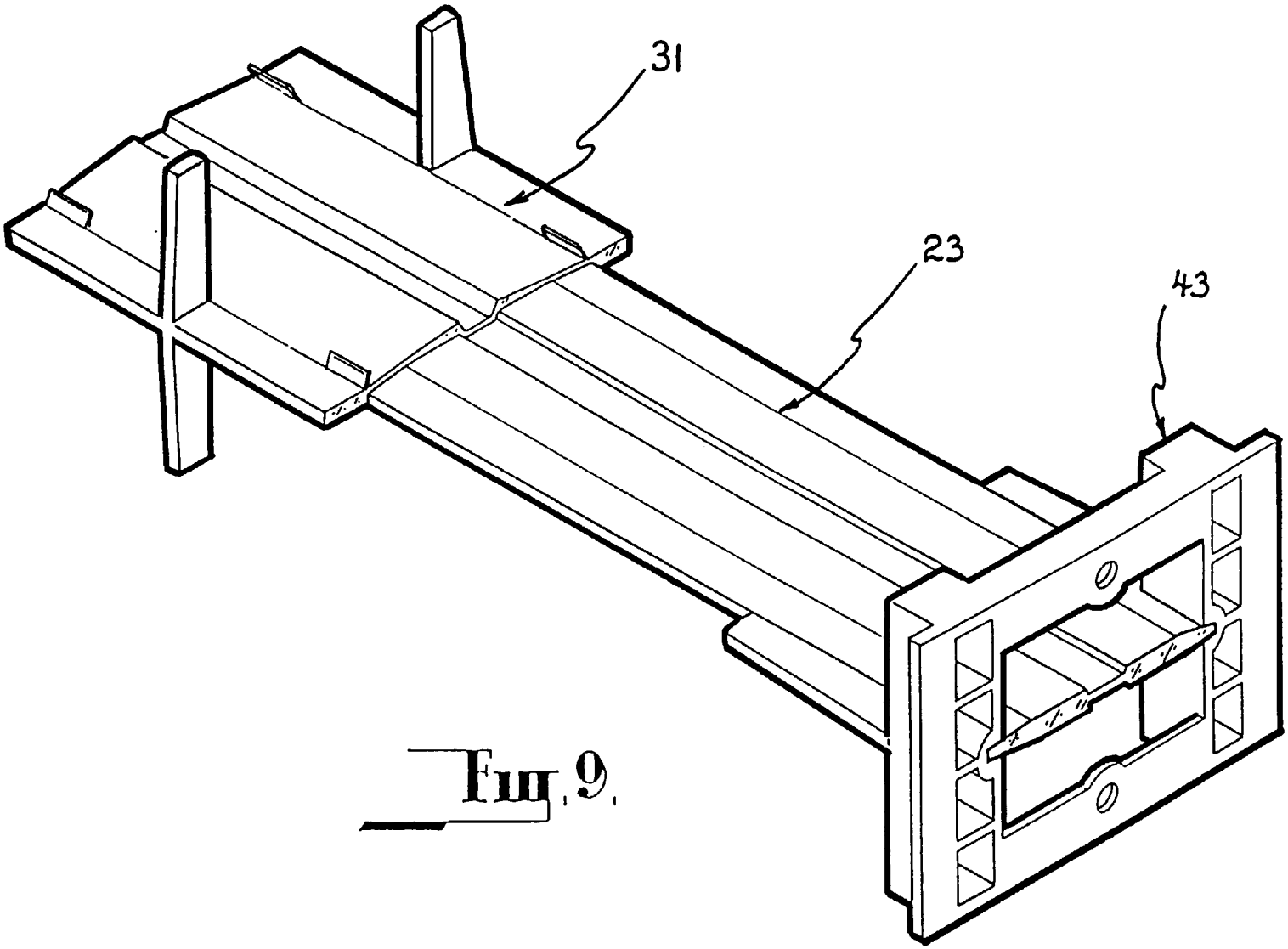
FIG. 9 is a perspective view showing both an intermediate junction spacer and an end junction spacer connected to the reinforcement member.
Figure 10:
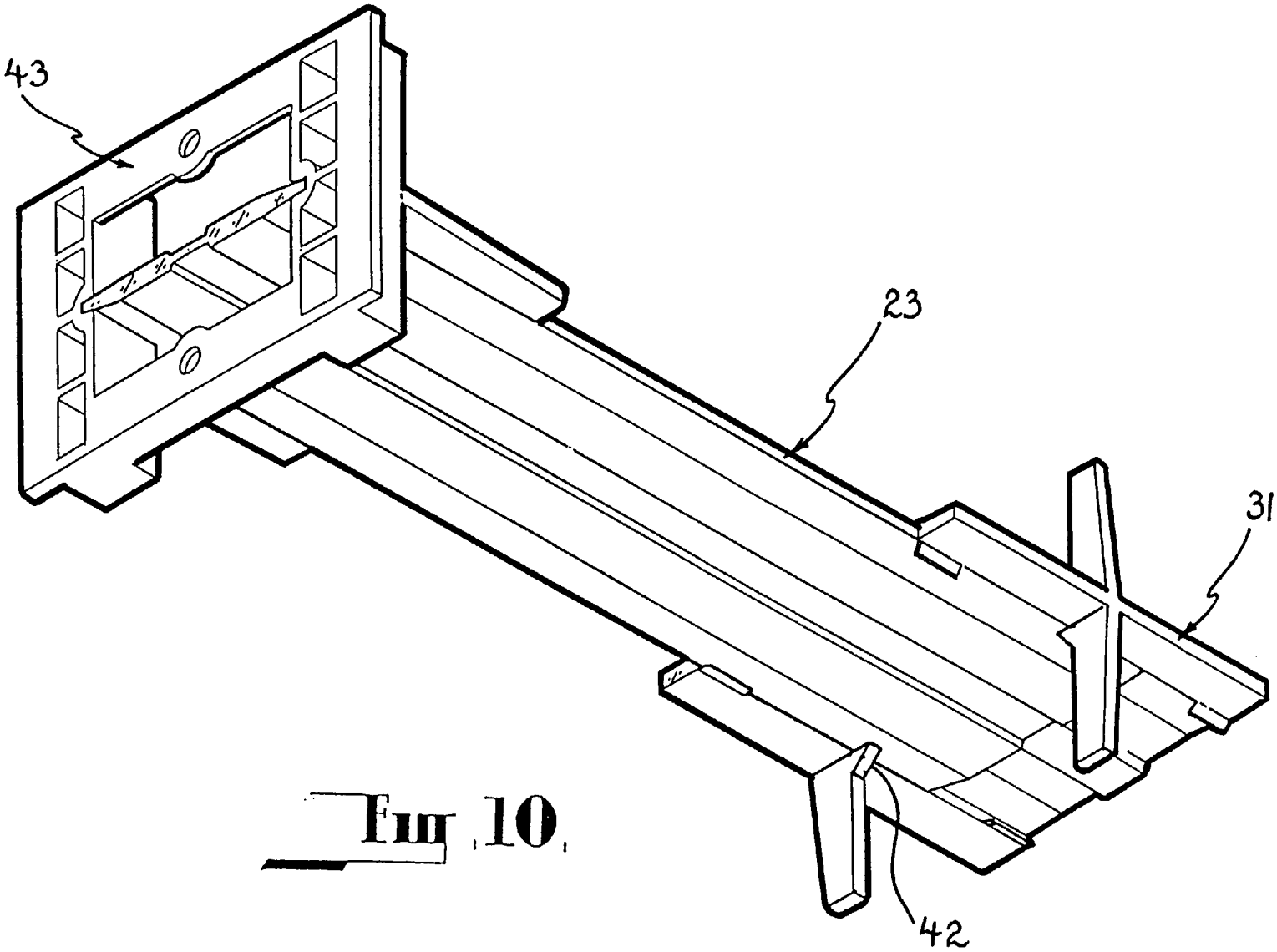
FIG. 10 is an underside view of FIG. 9.
Figure 11:
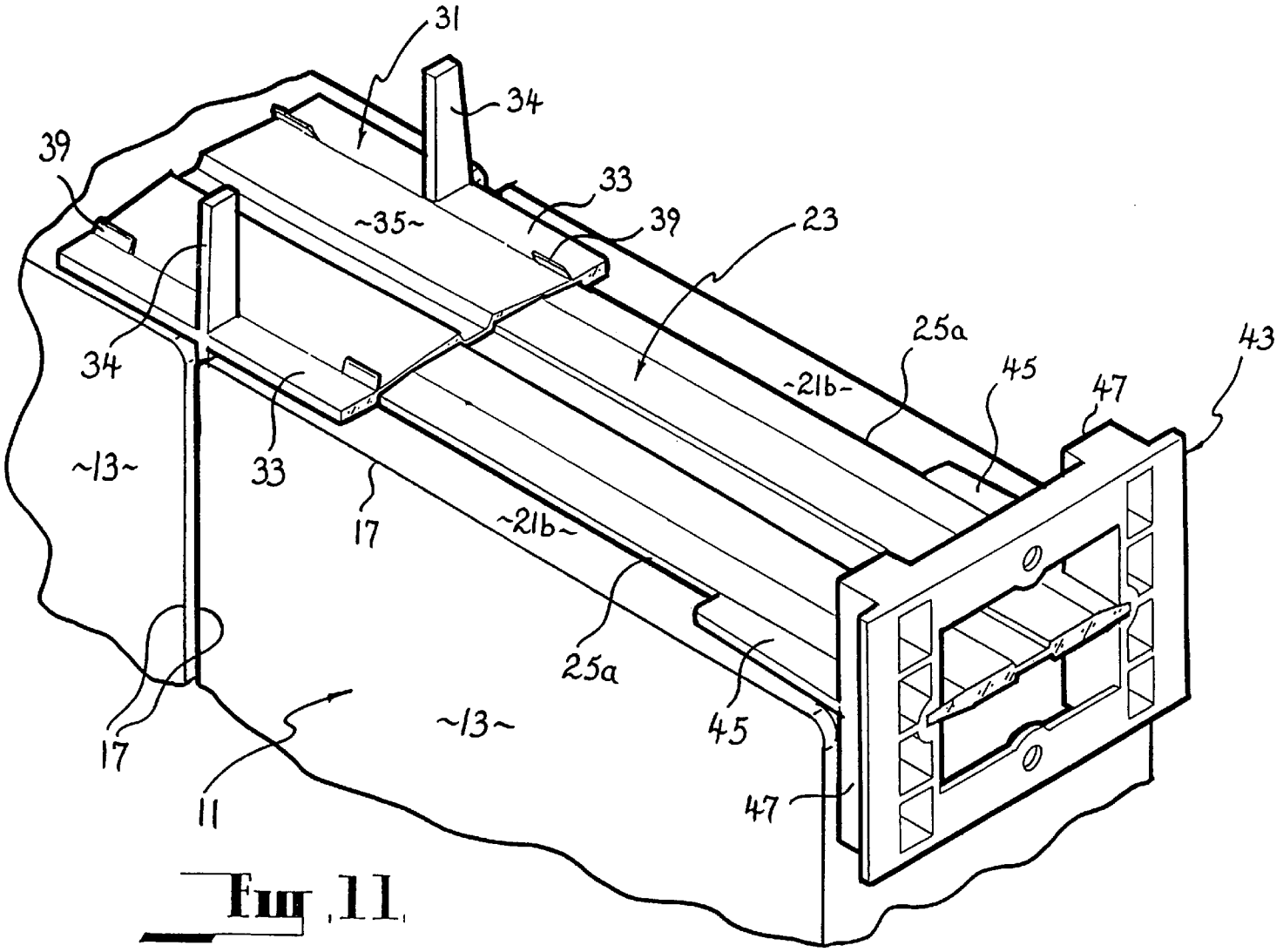
FIG. 11 shows the composite reinforcement and spacer system of FIGS. 9 and 10 positioned upon two adjacent blocks, one of which is disposed at the end of the wall.
Figure 12:
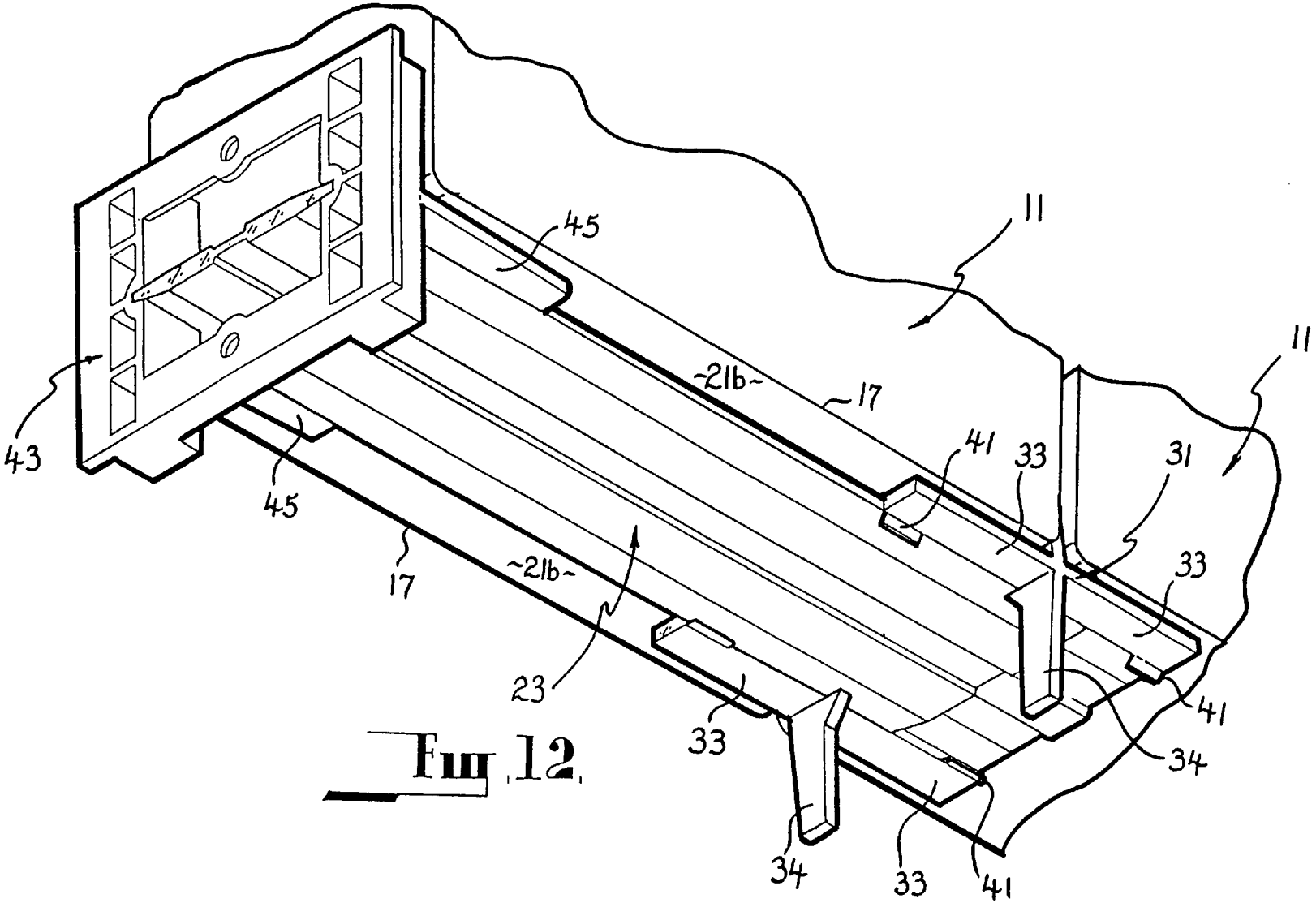
FIG. 12 is a similar view to FIG. 11 but showing the positioning of blocks on top of the composite arrangement.

The edge members 47 of the other spacer means are formed with a pair of opposing transverse grooves 59 which are disposed at the junction with the edge members 45 of the one spacer means. The longitudinal extent of each of the grooves 59 is respectively disposed in parallel alignment with each edge member 45 along the inner side of the edge members 47. The grooves 59 are particularly sized and shaped to retainedly accommodate the opposing edges 25*a* of the elongate reinforcement member 23, as best shown in FIGS. 9 and 10 of the drawings. Accordingly, the end junction spacer 43 is fitted onto the end of a reinforcement member 25 whereby the reinforcement member may project through the central aperture 51 of the web portion 49 if necessary with the edge members 45 being disposed and projecting outwardly from the outer edges 25*a* of the member to still provide the requisite spacing between adjacent blocks which are situated on either side of the edge members 45.

The edge members 47 still provide a spacing function, but instead of them defining the spacing between adjacent glass blocks, as is the case with both spacer means of the intermediate junction spacer, they define the spacing between the outer face of the end blocks and the wall frame or surround confronting the ends of the glass block.

Having now described each of the components of the construction system, the method of constructing a glass block wall using the system will now be described.

Figure 14:
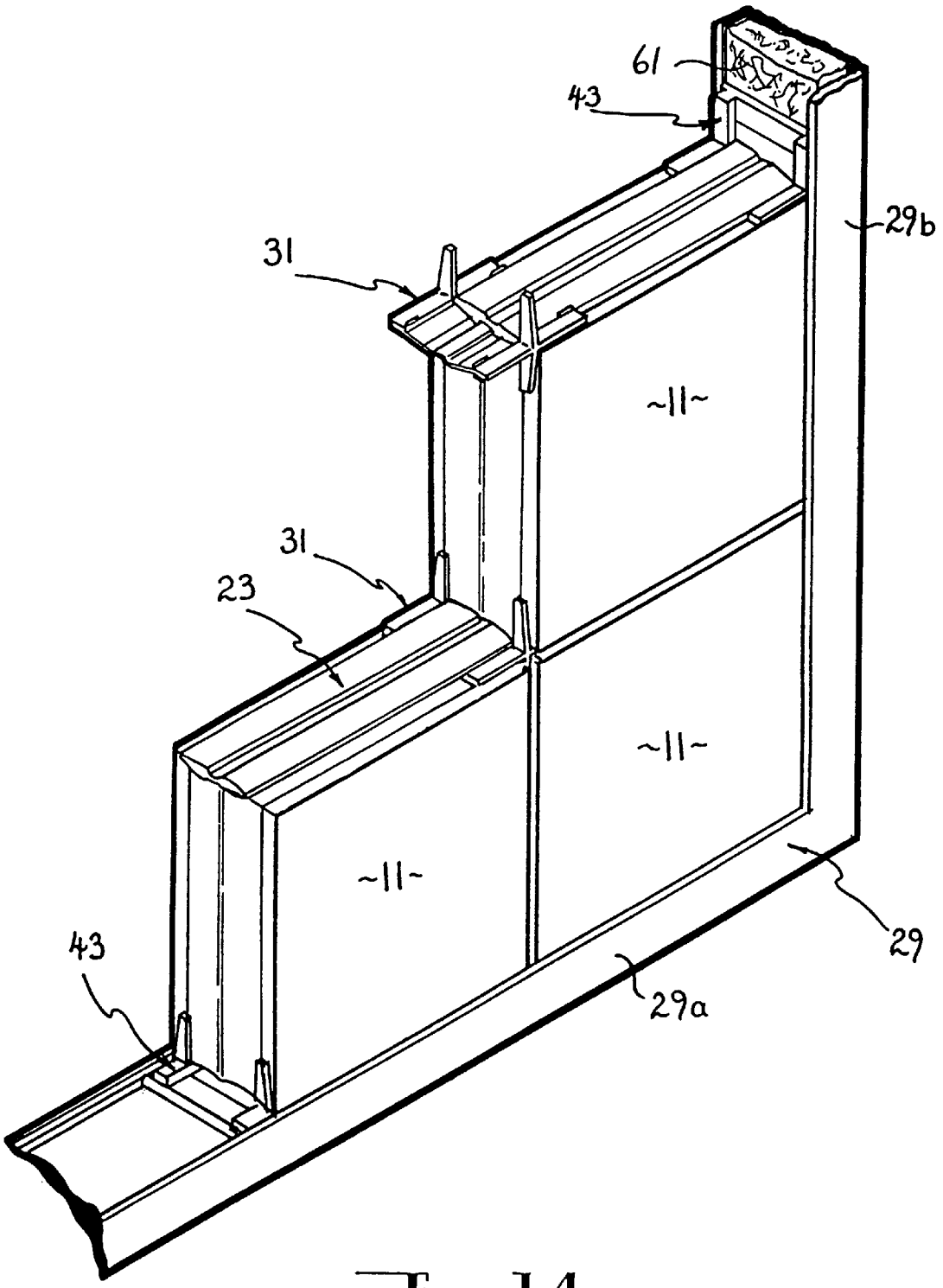
FIG. 14 is a perspective fragmentary view showing a block wall under construction.

As previously mentioned, the glass blocks 11 are laid within a rectangular frame 29, as best shown in FIG. 14 of the drawings.

Although the present embodiment describes the use of a rectangular frame 29, the invention is not so limited and accordingly, finds equal utility where a glass block wall is desired to be constructed directly within a window or wall surround or the like, whereby the rectangular frame 29 is dispensed within entirely and the glass blocks are required to abut directly to the brickwork or other member forming the surround.

In the latter case, as previously described, the end junction spacers 43 may be affixed directly to the outer surface of the confronting brickwork or the like by the use of fixing screws which are mounted through the holes 53 to securely position the end junction spacer and to provide a guide for the subsequent positioning of the blocks.

Returning to the principal embodiment, however, the frame 29 is used and essentially comprises a head member, (not shown) which is disposed along the top of the glass wall to be constructed, a sill member 29*a* which is disposed along the bottom of the glass wall to be constructed, and a pair of jambs 29*b* which are disposed at either end of the glass wall to be constructed to define its sides. The frame effectively forms a U-shaped channel and the distance between the opposing jambs and the opposing head and sill members is predetermined to allow for the exact number of glass blocks to form a rectangular matrix within the frame 29, taking into account the prescribed spacing therebetween, which in the present embodiment is 3 mm.

To commence the construction, a strip of polystyrene foam 61 conforming to the spacing between the sides of the frame 29 is disposed within the channel members of each jamb member 29*b*.

Next, one of the end junction spacers 23 is taken and modified to form a corner spacer. In this respect, the other spacer means has one end of it removed, by simply sawing through it with a hacksaw or the like. More particularly, the edge members 47 are transversely cut a prescribed distance from the junction with the edge members 45 removing one of the interconnecting web portion 49 from the spacer. Consequently, the modified spacer will have a pair of shortened legs formed by the remainder of the edge members 47 at one side of the other spacing member, of a length commensurate to the height of the edge members 47. This modified spacer is then disposed within the corner of the frame so that the planar side 43*a* of the spacer sits upon the inner web of the sill member 29*a* and the shortened legs of the other spacer means abut up against the outer surface of the polystyrene 61 on the jamb member 29*b*. As previously described, the distance between the end flanges 57 is commensurate to the distance between the sides of the frame, and consequently, the modified spacer will sit precisely within the confines of the channel of the sill.

After positioning the modified end spacer, a complete end junction spacer 43 is similarly disposed along the web of the sill, a distance approximating the size of one side of a glass block. At this position, the edge members 45 will project upwardly and the edge members 47 will extend in parallel relationship with the sides of the sill to provide a base on which the outer cusps of the glass block may repose.

A glass block is then positioned so that the respective edge members 45 and 47 support the block along its corresponding outer cusps 23*b* at each corner of the block.

It should be noted that the edge members 47 are of greater height and hence thickness than the edge members 45 due to the increased loading of the block thereon, and the need to space the bottom of the block from the inner web of the sill at a distance greater than the 3 mm adopted for the remaining spacing.

Further end junction spacers are subsequently positioned and glass blocks in turn positioned upon them along the bottom of the sill, the spacing of the vertical interstices between the blocks being determined by the edge members 45.

It should be noted that the distance between the outer sides of the opposing edge members 45 and 47 is marginally less than the transverse extent of a block, but greater than the overall concave extent of the end face of the block, so that the end members can support the block adequately along its outer cusps. Thus, a sufficient recess is provided along the joint where the spacers are disposed to allow for the silicone binder to be caulked into the recess in the known manner.

After the first row of glass blocks are laid, and in this respect a modified end junction spacer is fitted into the corner of the sill and the other jamb in the same manner as the first corner, the principal part of the reinforcing interstitial spacer system is then constructed and positioned. Moreover, a prescribed length of reinforcement member 23 is obtained, end junction spacers are fitted onto either end in a manner previously described and intermediate junction spacers are clipped into place at prescribed locations along the bar corresponding to the location of the vertical joints. Thus, the unit as shown in part in FIGS. 9 and 10 is assembled and positioned along the top of the glass blocks 11 so that the planar surface 43*a* of the end junction spacers engage the respective strips of polystyrene 61 and the edge members 47 are slid along the outer cusps of the end glass blocks, at the same time as the edge members 34 of the intermediate junction spacers are aligned and positioned between the confronting vertical outer cusps of adjacent blocks to provide the spacing for the vertical joints.

As previously described, the complementary shape of the spacers and the reinforcement member allow the assembled unit to position itself along the composite upper circumferential edge formed by the glass blocks, supporting and in turn accurately positioning the glass blocks themselves to allow the next row of blocks to be laid thereon.

The next row of glass blocks is laid by simply inserting one block at a time between the exposed upwardly projecting edge members 34 of the intermediate junction spacers and the upwardly projecting edge members 47 of the end junction spacers 43 of the positioned unit. This method is then repeated for subsequent rows until the top row is laid, whereby the sequence needs to be modified by making the last glass block to be erected, one of the blocks intermediate the corner blocks. In addition, positioning spacers and the reinforcement member along the very top of the top row is dispensed with to facilitate locating the glass blocks within the head of the frame.

Once the matrix of glass blocks is complete, the silicone binder can be inserted by caulking along the grooves formed by the spacing between the blocks which results from the positioning of the various spacers.

After the silicone binder is set, a glass block wall construction is achieved having superior loading characteristics than is able to be achieved with the use of prior art construction systems, as a result of reinforcing and support being provided in the vertical as well as the horizontal interstices of the matrix of blocks.

Although the preceding embodiment describes a glass block wall construction system wherein the reinforcement members are essentially disposed along the horizontal joints, these members may equally be disposed along the vertical joints and achieve similar superior loading characteristics.

Furthermore, the spacers have utility not only in the construction of planar faced walls, but also can be used in the construction of curved walls. In curved walls, the reinforcement members will be disposed within the vertical joints so that with respect to the intermediate junction spacers, these will be disposed with the one spacer means thereof extending vertically to accommodate the reinforcement members and the other spacer means disposed horizontally. In this manner, the tapered outer surface 34*a* of each edge member 34, and in the case of the edge junction spacers, the edge members 45, enable a block to be marginally offset angularly to achieve the curvature, without the outer surface of the edge members projecting outwardly beyond the confines of the joint.

It should be appreciated that the scope of the present invention is not limited to the particular embodiment and variations thereof described herein. Indeed, variations to the method of laying the glass blocks and variations in the nature of the components used in the construction system may be envisaged in accordance with particular applications differing from that described in the embodiment, without departing from the spirit of the invention. For example, an intermediate junction spacer can be conceived using some of the features of the end junction spacer described, whereby the interconnecting web portion is provided with a central aperture through which a reinforcement member may pass, the web being substantially orthogonal to the reinforcement member.

What is claimed is:

1. An interstitial junction spacer for positioning and supporting a plurality of blocks in a matrix for a wall construction, said blocks being of the type having two parallel rectangular side faces and four adjoining end faces orthogonally adjoining the corresponding edges of said side faces and the ends of each other contiguously to form a continuous circumferential edge of the block, the profile of said circumferential edge being substantially concave, whereby said corresponding edges of said side faces define an outer cusp along the opposing sides of each said end face; said spacer comprising:

a pair of intersecting and integral spacer means, each said spacer means having a pair of coplanar edge members of a prescribed thickness, spaced apart a distance commensurate to the spacing of a pair of corresponding said outer cusps so that a said spacer means may be reposed in juxtaposition with the outer cusps of the circumferential edge of one said block along one said end face of said one said block, to space said one said end face from a confronting end face of another said block or a surface disposed in abutting relationship adjacent to said one said block; and an interconnecting web portion disposed between said edge members of each said spacer means to integrally interconnect said spacer means together;

wherein at least one said spacer means is formed to accommodate and retainedly dispose an elongate, substantially planar reinforcement member in coplanar relationship between said edge members of said one said spacer means and in orthogonal relationship with the other said spacer means.

2. An interstitial junction spacer as claimed in claim 1, wherein an outer surface of each said edge member of said one or said other said spacer means is tapered inwardly, from a proximal end of said each said edge member to a distal end thereof.

3. An interstitial junction spacer as claimed in claim 1, wherein said web portion is contiguously disposed between said edge members of said one of said spacer means in generally coplanar relationship therewith and is biased towards one side thereof and has: (i) an outer surface of approximate complementary shape to said profile of said circumferential edge of a said block, whereby the profile of said outer surface is substantially convex to repose between the said outer cusps of a pair of rectilinearly aligned said end faces of adjacent said blocks and (ii) an inner recessed surface to engage and connect said interstitial junction spacer to said reinforcement member and accommodate said reinforcement member within an interstice of a pair of abutting said blocks spaced apart by said one said spacer means.

4. An interstitial junction spacer as claimed in claim 3 for spacing an intermediate interstitial junction within a rectangular matrix of said blocks, each said block including a central inner cuss disposed intermediate said outer cusps of each said end face thereof, said inner cusp extending continuously along said circumferential edge of said block, wherein said interconnecting web portion is formed with a central longitudinal groove along said outer surface for accommodating a pair of rectilineally aligned said inner cusps of a pair of adjacent said blocks in said rectangular matrix.

5. An interstitial junction spacer as claimed in claim 3 for spacing an intermediate interstitial junction within a rectangular matrix of said blocks, including a plurality of outwardly projecting spacer tabs disposed along said outer surface of said interconnecting web portion at the opposing junctions between said web portion and said edge members of said one said spacer means, said spacer tabs being angularly disposed to project marginally inwardly from each of said edge members for engaging the concave surface of a said end face of an adjacent said block to facilitate positioning said interstitial junction spacer within the confines of said end face of said adjacent said block.

6. An interstitial junction spacer as claimed in claim 3 for spacing an intermediate interstitial junction within a rectangular matrix of said blocks, including a plurality of opposing spacer tabs projecting outwardly from each of said edge members of said one said spacer means proximate to the opposing junctions between said edge members and said interconnecting web portion, adjacent to said inner recessed surface of said web portion, said opposing spacer tabs being angularly disposed to project marginally inwardly from each of said edge members for engaging the concave surface of an end face of an adjacent said block and for partly retaining said reinforcement member therein.

7. An interstitial junction spacer as claimed in claim 3 for spacing an intermediate interstitial junction within a rectangular matrix of said blocks, including a pair of retentioning tabs, one disposed along each inner edge of said edge members of said other spacer means proximate to the junction with the inner edge of the corresponding said edge members of said one said spacer means, said retentioning tabs projecting marginally inwardly over said inner recessed surface of said web portion to define an overhanging surface substantially parallel with said inner recessed surface for retaining said reinforcement member in position.

8. An interstitial junction spacer as claimed in claim 7, wherein said retentioning tabs each have an outer tapered surface extending along said inner edge of said edge member thereof to said overhanging surface to facilitate locating said reinforcement member within the inner recessed surface.

9. An interstitial junction spacer as claimed in claim 5, wherein said spacer tabs are formed of resilient, flexible material.

10. An interstitial junction spacer as claimed in claim 3 wherein said inner recessed surface is of substantially complementary shape to an expansive side of said reinforcement member, whereby the opposing inner edges of said inner recessed surface are defined by the inner edges of the opposing said edge members of said one of said spacer means to engage the opposing longitudinally extending edges of said reinforcement member.

11. An interstitial junction spacer as claimed in claim 1, wherein said other said spacer means is formed with a pair of opposing transverse grooves at the junction with said one said spacer means, the longitudinal extent of each said groove being respectively disposed in parallel alignment with each said edge member of said one said spacer means, said grooves being sized and shaped for retainedly accommodating the opposing longitudinally extending edges of said reinforcement member.

12. An interstitial junction spacer as claimed in claim 11 for spacing an end interstitial junction at the end of a rectangular matrix of said blocks, wherein said one said spacer means projects from said other said spacer means on only one side of said interstitial junction spacer, the opposing side of said interstitial junction spacer being planar to engage a planar surface confronting said end of said rectangular matrix of said blocks.

13. An interstitial junction spacer as claimed in claim 11 for spacing an end interstitial junction at the end of a rectangular matrix of said blocks, wherein said web portion is provided with one or more holes to facilitate fixing said interstitial junction spacer to a planar surface confronting said end of said rectangular matrix of said blocks.

14. An interstitial junction spacer as claimed in claim 11, wherein said web portion is provided with a central aperture, through which said reinforcement member may extend.

15. An interstitial junction spacer as claimed in claim 14, wherein said web portion is divided into two parts respectively interconnecting said edge members of said other said spacer means, each part being formed with an upstanding longitudinal rail extending between said edge members of said other said spacer means.

16. An interstitial junction spacer as claimed in claim 14, wherein said web portion includes an end flange disposed at either end thereof to project laterally from the side of each said edge member of said other said spacer means.

17. An interstitial junction spacer as claimed in claim 6, wherein said opposing spacer tabs are formed of resilient, flexible material.

18. An interstitial junction spacer as claimed in claim 7, wherein said retentioning tabs are formed of resilient, flexible material.

19. A reinforcing interstitial spacer system for positioning and supporting a plurality of blocks in a rectangular matrix for a wall construction, the blocks being of the type having two parallel rectangular side faces and four adjoining end faces orthogonally adjoining the corresponding edges of said side faces and the ends of each other contiguously to form a continuous circumferential edge of the block, the profile of said circumferential edge being substantially concave, whereby said corresponding edges of said side faces define an outer cusp along the opposing sides of each said end face; said system comprising:

a) an elongate, substantially planar reinforcement member having a pair of opposing expansive sides, each said side being substantially complementary in shape to that portion of an end face of a block between the outer cusps thereof, whereby the profile of each expansive side is substantially convex to repose between the outer cusps; and b) a plurality of interstitial junction spacers for positioning and supporting said blocks in spaced relationship to each other at the interstitial junctions between said blocks, a said interstitial junction spacer comprising:

a pair of intersecting and integral spacer means, each said spacer means having a pair of coplanar edge members of a prescribed thickness, spaced apart a distance commensurate to the spacing of a pair of corresponding said outer cusps so that a said spacer means may bereposed in juxtaposition with the outer cusps of the circumferential edge of one said block along one said end face of said one said block, to space said one said end face from a confronting end face of another block or a surface disposed in abutting relationship adjacent to said one said block; and an interconnecting web portion disposed between said edge members of each said spacer means to integrally interconnect said spacer means together;

wherein at least one of said spacer means is formed to accommodate and retainedly dispose said reinforcement member in coplanar relationship between said edge members of said one said spacer means and in orthogonal relationship with the other said spacer means.

20. A reinforcing interstitial spacer system as claimed in claim 19, wherein said reinforcement member is of a flattened shape, each end comprising a thickened wing interconnected by a central web, said central web being of a thinner dimension than said wings to form an elongated groove.

21. A reinforcing interstitial spacer system as claimed in claim 19, wherein an outer surface of each said edge member of said one or said other said spacer means is tapered inwardly, from a proximal end of said each said edge member to a distal end thereof.

22. A reinforcing interstitial spacer system as claimed in claim 19, wherein said web portion is contiguously disposed between said edge members of said one of said spacer means in generally coplanar relationship therewith and is biased towards one side thereof and has: (i) an outer surface of approximate complementary shape to said profile of said circumferential edge of a said block, whereby the profile of said outer surface is substantially convex to repose between the said outer cusps of a pair of rectilinearly aligned said end faces of adjacent said blocks and (ii) an inner recessed surface to engage and connect said interstitial junction spacer to said reinforcement member and accommodate said elongate reinforcement member within an interstice of a pair of abutting said blocks spaced apart by said one said spacer means.

23. A reinforcing interstitial spacer system as claimed in claim 22, wherein said interstitial junction spacer is for spacing an intermediate interstitial junction within a rectangular matrix of said blocks, each said block including a central inner cusp disposed intermediate said outer cusps of each said end face thereof, said inner cusp extending continuously along said circumferential edge of said block, and wherein said interconnecting web portion is formed with a central longitudinal groove along said outer surface for accommodating a pair of rectilineally aligned said inner cusps of a pair of adjacent said blocks in said rectangular matrix.

24. A reinforcing interstitial spacer system as claimed in claim 22, wherein said interstitial junction spacer is for spacing an intermediate interstitial junction within a rectangular matrix of said blocks, and includes a plurality of outwardly projecting spacer tabs disposed along said outer surface of said interconnecting web portion at the opposing junctions between said web portion and said edge members of said one spacer means, said spacer tabs being angularly disposed to project marginally inwardly from each of said edge members for engaging the concave surface of a said end face of an adjacent said block to facilitate positioning said interstitial junction spacer within the confines of said end face of said adjacent said block.

25. A reinforcing interstitial spacer system as claimed in claim 22, wherein said interstitial junction spacer is for spacing an intermediate interstitial junction within a rectangular matrix of said blocks, including a plurality of opposing spacer tabs projecting outwardly from each of said edge members of said one said spacer means proximate to the opposing junctions between said edge members and said interconnecting web portion, adjacent to said inner recessed surface of said web portion, said opposing spacer tabs being angularly disposed to project marginally inwardly from each of said edge members for engaging the concave surface of an end face of an adjacent said block and for partly retaining said reinforcement member therein.

26. A reinforcing interstitial spacer system as claimed in claim 22, wherein said interstitial junction spacer is for spacing an intermediate interstitial junction within a rectangular matrix of said blocks, and includes a pair of retentioning tabs, one disposed along each inner edge of said edge members of said other spacer means proximate to the junction with the inner edge of the corresponding said edge members of said one said spacer means, said retentioning tabs projecting marginally inwardly over said inner recessed surface of said web portion to define an overhanging surface substantially parallel with said inner recessed surface for retaining said reinforcement member in position.

27. A reinforcing interstitial spacer system as claimed in claim 26, wherein said retentioning tabs each have an outer tapered surface extending along said inner edge of said edge member thereof to said overhanging surface to facilitate locating said reinforcement member within the inner recessed surface.

28. A reinforcing interstitial spacer system as claimed in claim 24, wherein said spacer tabs are formed of resilient, flexible material.

29. A reinforcing interstitial spacer system as claimed in claim 25, wherein said opposing spacer tabs are formed of resilient, flexible material.

30. A reinforcing interstitial spacer system as claimed in claim 26, wherein said retentioning tabs are formed of resilient, flexible material.

31. A reinforcing interstitial spacer system as claimed in claim 22, wherein said inner recessed surface is of substantially complementary shape to an expansive side of said reinforcement member, whereby the opposing inner edges of said inner recessed surface are defined by the inner edges of the opposing said edge members of said one of said spacer means to engage the opposing longitudinally extending edges of said reinforcement member.

32. A reinforcing interstitial spacer system as claimed in claim 19, wherein said other said spacer means is formed with a pair of opposing transverse grooves at the junction with said one said spacer means, the longitudinal extent of each said groove being respectively disposed in parallel alignment with each said edge member of said one said spacer means, said grooves being sized and shaped for retainedly accommodating the opposing longitudinally extending edges of said reinforcement member.

33. A reinforcing interstitial spacer system as claimed in claim 32, wherein said interstitial junction spacer is for spacing an end interstitial junction at the end of a rectangular matrix of said blocks, and wherein said one of said spacer means projects from said other of said spacer means on only one side of said interstitial junction spacer, the opposing side of said interstitial junction spacer being planar to engage a planar surface confronting said end of said rectangular matrix of said blocks.

34. A reinforcing interstitial spacer system as claimed in claim 32, wherein said interstitial junction spacer is for spacing an end interstitial junction at the end of a rectangular matrix of said blocks, and wherein said web portion is provided with one or more holes to facilitate fixing said interstitial junction spacer to a planar surface confronting said end of said rectangular matrix of said blocks.

35. A reinforcing interstitial spacer system as claimed in claim 32, wherein said web portion is provided with a central aperture, through which said reinforcement member may extend.

36. A reinforcing interstitial spacer system as claimed in claim 35, wherein said web portion is divided into two parts respectively interconnecting said edge members of said other said spacer means, each part being formed with an upstanding longitudinal rail extending between said edge members of said other said spacer means.

37. A reinforcing interstitial spacer system as claimed in claim 35, wherein said web portion includes an end flange disposed at either end thereof to project laterally from the side of each said edge member of said other said spacer means.

38. A block wall construction system comprising:

i) a plurality of blocks of the type having two parallel rectangular side faces and four adjoining end faces orthogonally adjoining the corresponding edges of said side faces and the ends of each other contiguously to form a continuous circumferential edge of the block, the profile of said circumferential edge being substantially concave, whereby said corresponding edges of said side faces define an outer cusp along the opposing sides of each said end face;

ii) a reinforcing interstitial spacer system for positioning and supporting said blocks in a rectangular matrix; and iii) a binder for filling the outer spaces of the interstices of said matrix formed by said blocks and said reinforcing interstitial spacer system to bind the same together and form a stable wall construction;

wherein said spacer system comprises:

a) an elongate, substantially planar reinforcement member having a pair of opposing expansive sides, each said side being substantially complementary in shape to that portion of an end face of a block between the outer cusps thereof, whereby the profile of each expansive side is substantially convex to repose between the outer cusps; and b) a plurality of interstitial junction spacers for positioning and supporting said blocks in spaced relationship to each other at the interstitial junctions between said blocks, a said interstitial junction spacer comprising: a pair of intersecting and integral spacer means, each said spacer means having a pair of coplanar edge members of a prescribed thickness, spaced apart a distance commensurate to the spacing of a pair of corresponding said outer cusps so that a said spacer means may be reposed in juxtaposition with the outer cusps of the circumferential edge of one said block along one said end face of said one said block, to space said one said end face from a confronting end face of another block or a surface disposed in abutting relationship adjacent to said one said block; and an interconnecting web portion disposed between said edge members of each said spacer means to integrally interconnect said spacer means together;

wherein at least one of said spacer means is formed to accommodate and retainedly dispose said reinforcement member in coplanar relationship between said edge members of said one said spacer means and in orthogonal relationship with the other said spacer means.

39. A block wall construction system as claimed in claim 38, wherein said binder is a silicone caulking material.

40. A block wall construction system as claimed in claim 38, wherein said reinforcement member is of a flattened shape, each end comprising a thickened wing interconnected by a central web, said central web being of a thinner dimension than said wings to form an elongated groove.

41. A block wall construction system as claimed in claim 38, wherein an outer surface of each said edge member of said one or said other said spacer means is tapered inwardly, from a proximal end of said each said edge member to a distal end thereof.

42. A block wall construction system as claimed in claim 38, wherein said web portion is contiguously disposed between said edge members of said one of said spacer means in generally coplanar relationship therewith and is biased towards one side thereof and has: (i) an outer surface of approximate complementary shape to said profile of said circumferential edge of a said block, whereby the profile of said outer surface is substantially convex to repose between the said outer cusps of a pair of rectilinearly aligned said end faces of adjacent said blocks and (ii) an inner recessed surface to engage and connect said interstitial junction spacer to said reinforcement member and accommodate said elongate reinforcement member within an interstice of a pair of abutting said blocks spaced apart by said one said spacer means.

43. A block wall construction system as claimed in claim 42, wherein said interstitial junction spacer is for spacing an intermediate interstitial junction within a rectangular matrix of said blocks and wherein each said block including a central inner cusp disposed intermediate said outer cusps of each said end face thereof, said inner cusp extending continuously along said circumferential edge of said block, wherein said interconnecting web portion is formed with a central longitudinal groove along said outer surface for accommodating a pair of rectilineally aligned said inner cusps of a pair of adjacent said blocks in said rectangular matrix.

44. A block wall construction system as claimed in claim 42, wherein said interstitial junction spacer is for spacing an intermediate interstitial junction within a rectangular matrix of said blocks and includes a plurality of outwardly projecting spacer tabs disposed along said outer surface of said interconnecting web portion at the opposing junctions between said web portion and said edge members of said one spacer means, said spacer tabs being angularly disposed to project marginally inwardly from each of said edge members for engaging the concave surface of a said end face of an adjacent said block to facilitate positioning said interstitial junction spacer within the confines of said end face of said adjacent said block.

45. A block wall construction system as claimed in claim 42, wherein said interstitial junction spacer is for spacing an intermediate interstitial junction within a rectangular matrix of said blocks, and includes a plurality of opposing spacer tabs projecting outwardly from each of said edge members of said one said spacer means proximate to the opposing junctions between said edge members and said interconnecting web portion, adjacent to said inner recessed surface of said web portion, said opposing spacer tabs being angularly disposed to project marginally inwardly from each of said edge members for engaging the concave surface of an end face of an adjacent said block and for partly retaining said reinforcement member therein.

46. A block wall construction system as claimed in claim 42, wherein said interstitial junction spacer is for spacing an intermediate interstitial junction within a rectangular matrix of said blocks, and includes a pair of retentioning tabs, one disposed along each inner edge of said edge members of said other spacer means proximate to the junction with the inner edge of the corresponding said edge members of said one said spacer means, said retentioning tabs projecting marginally inwardly over said inner recessed surface of said web portion to define an overhanging surface substantially parallel with said inner recessed surface for retaining said reinforcement member in position.

47. A block wall construction system as claimed in claim 46, wherein said retentioning tabs each have an outer tapered surface extending along said inner edge of said edge member thereof to said overhanging surface to facilitate locating said reinforcement member within the inner recessed surface.

48. A block wall construction system as claimed in claim 44, wherein said spacer tabs are formed of resilient, flexible material.

49. A block wall construction system as claimed in claim 46, wherein said opposing spacer tabs are formed of resilient, flexible material.

50. A block wall construction system as claimed in claim 46, wherein said retentioning tabs are formed of resilient, flexible material.

51. A block wall construction system as claimed in claim 42, wherein said inner recessed surface is of substantially complementary shape to an expansive side of said reinforcement member, whereby the opposing inner edges of said inner recessed surface are defined by the inner edges of the opposing said edge members of said one of said spacer means to engage the opposing longitudinally extending edges of said reinforcement member.

52. A block wall construction system as claimed in claim 38, wherein said other said spacer means is formed with a pair of opposing transverse grooves at the junction with said one said spacer means, the longitudinal extent of each said groove being respectively disposed in parallel alignment with each said edge member of said one said spacer means, said grooves being sized and shaped for retainedly accommodating the opposing longitudinally extending edges of said reinforcement member.

53. A block wall construction system as claimed in claim 52, wherein said interstitial junction spacer is for spacing an end interstitial junction at the end of a rectangular matrix of said blocks, and wherein said one of said spacer means projects from said other of said spacer means on only one side of said interstitial junction spacer, the opposing side of said interstitial junction spacer being planar to engage a planar surface confronting said end of said rectangular matrix of said blocks.

54. A block wall construction system as claimed in claim 52, wherein said interstitial junction spacer is for spacing an end interstitial junction at the end of a rectangular matrix of said blocks, and wherein said web portion is provided with one or more holes to facilitate fixing said interstitial junction spacer to a planar surface confronting said end of said rectangular matrix of said blocks.

55. A block wall construction system as claimed in claim 52, wherein said web portion is provided with a central aperture, through which said elongate reinforcement member may extend.

56. A block wall construction system as claimed in claim 55, wherein said web portion is divided into two parts respectively interconnecting said edge members of said other said spacer means, each part being formed with an upstanding longitudinal rail extending between said edge members of said other said spacer means.

57. A block wall construction system as claimed in claim 55, wherein said web portion includes an end flange disposed at either end thereof to project laterally from the side of each said edge member of said other said spacer means.

* * * * *